US009692167B2

(12) United States Patent
Kobuchi et al.

(10) Patent No.: US 9,692,167 B2
(45) Date of Patent: Jun. 27, 2017

(54) CONNECTOR MOUNTABLE ON A CIRCUIT BOARD AND HAVING A COUPLING PORTION COUPLING AN ENCLOSING PORTION WITH A HOUSING

(71) Applicant: Japan Aviation Electronics Industry, Limited, Tokyo (JP)

(72) Inventors: Toshiro Kobuchi, Tokyo (JP); Takayuki Nishimura, Tokyo (JP); Hiroaki Obikane, Tokyo (JP); Katsumi Arai, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/039,134

(22) Filed: Sep. 27, 2013

(65) Prior Publication Data

US 2014/0099804 A1 Apr. 10, 2014

(30) Foreign Application Priority Data

Oct. 5, 2012 (JP) ..... 2012-222703

(51) Int. Cl.
*H01R 13/52* (2006.01)
*H01R 12/73* (2011.01)
(Continued)

(52) U.S. Cl.
CPC ..... *H01R 13/426* (2013.01); *H01R 12/716* (2013.01); *H01R 12/73* (2013.01); *H01R 13/5213* (2013.01); *H01R 13/5219* (2013.01)

(58) Field of Classification Search
CPC ..... H01R 12/70; H01R 13/52; H01R 13/533; H01R 12/716; H01R 13/5213; H01R 13/5219
(Continued)

(56) References Cited

U.S. PATENT DOCUMENTS 6,986,670 B2 * 1/2006 Okura ..... H01R 13/6275 439/74
7,101,196 B1 * 9/2006 McClelland ..... 439/74
(Continued)

FOREIGN PATENT DOCUMENTS

CN 2450801 Y 9/2001
JP H10-106684 A 4/1998
(Continued)

OTHER PUBLICATIONS

Japanese Office Action dated Sep. 12, 2013 in Japanese Application No. 2012-222703 with English translation.
(Continued)

*Primary Examiner* — Felix O Figueroa
*Assistant Examiner* — Paul Baillargeon
(74) *Attorney, Agent, or Firm* — Collard & Roe, P.C.

(57) ABSTRACT

A connector is mountable on a circuit board and mateable with a mating connector along a mating direction. The connector comprises a contact, a housing, an enclosing portion and a coupling portion. The housing holds the contact. The enclosing portion encloses an outer circumference of the housing in a plane perpendicular to the mating direction. The coupling portion directly or indirectly couples the enclosing portion with the housing so as to allow the enclosing portion to move along the mating direction relative to the housing.

11 Claims, 14 Drawing Sheets

(51) Int. Cl.
*H01R 13/426* (2006.01)
*H01R 12/71* (2011.01)

(58) Field of Classification Search
USPC ..... 439/367, 308, 313, 382, 384, 374, 377, 439/378, 379, 629, 680, 681, 246–248, 439/140, 141, 271–283, 556, 559, 587, 439/713, 718, 76.1, 74, 137, 358, 588
See application file for complete search history.

(56) References Cited

U.S. PATENT DOCUMENTS

| | | | | |
|---|---|---|---|---|
| 8,292,630 | B1 * | 10/2012 | Bobuk ..... | H01R 12/73 439/136 |
| 8,425,250 | B2 | 4/2013 | Kagotani | |
| 2013/0090001 | A1 | 4/2013 | Kagotani | |
| 2013/0183850 | A1 | 7/2013 | Kogotani | |

FOREIGN PATENT DOCUMENTS

| | | | |
|---|---|---|---|
| JP | H10-172685 | A | 6/1998 |
| JP | 2003-217746 | A | 7/2003 |
| JP | 2005-166302 | A | 6/2005 |
| JP | 2011-129459 | A | 6/2011 |
| TW | 200814450 | A | 3/2008 |

OTHER PUBLICATIONS

Chinese Office Action in 201310444854.4, issued May 27, 2015, with English translation.
Taiwan Office Action dated Oct. 21, 2015 in TW 102134948, with English translation.
Chinese Office Action dated Jan. 13, 2016 in Chinese Application No. 201310444854.4.
Finnish Office Action dated Dec. 4, 2015 in Finnish Application No. 20135974.

* cited by examiner

PRIOR ART

CONNECTOR MOUNTABLE ON A CIRCUIT BOARD AND HAVING A COUPLING PORTION COUPLING AN ENCLOSING PORTION WITH A HOUSING

CROSS REFERENCE TO RELATED APPLICATIONS

An applicant claims priority under 35 U.S.C. §119 of Japanese Patent Application No. JP2012-222703 filed Oct. 5, 2012.

BACKGROUND OF THE INVENTION

This invention relates to a connector configured to be mounted on a circuit board and configured to be mated with a mating connector.

For example, this type of connector is disclosed in JP-A H10(1998)-106684 (Patent Document 1) or JP-A H10 (1998)-172685 (Patent Document 2), contents of which are incorporated herein by reference.

As shown in FIG. 27, the connector 900 of Patent Document 1 is mateable with a mating connector 940. The connector 900 comprises contacts 910, a housing 920 holding the contacts 910, and a shell 930 covering the housing 920. Each of the contacts 910 has a Surface Mount Technology (SMT) portion 912 configured to be fixed on a circuit board (not shown). The housing 920 and the shell 930 constitute a body portion of the connector 900. The connector 900 has a gap formed between the body portion and the circuit board (not shown). The SMT portion 912 of the contact 910 extends outward of the shell 930 through the aforementioned gap. Accordingly, it is relatively easy to check whether the SMT portion 912 of the contact 910 is securely fixed to the circuit board or not. On the other hand, the contact 910 tends to be contaminated.

As shown in FIG. 28, the connector 950 of Patent Document 2 comprises contacts 960, a housing 970 and a shell 980. Each of the contacts 960 has an SMT portion 962. The shell 980 is fixed to the housing 970 and a circuit board 990 by using a screw 985 after the SMT portions 962 of the contacts 960 are fixed to the circuit board 990. The SMT portion 962 is enclosed by the shell 980. Accordingly, it is possible to prevent the contact 960 form being contaminated.

However, when the connector 950 of Patent Document 2 is installed to the circuit board 990, it is necessary to fix the shell 980 to the circuit board 990 by the screw 985 after checking whether the SMT portions 962 are fixed to the circuit board 990 or not. Accordingly, it is a cumbersome work to install the connector 950. Moreover, the shell 980 might fail to be attached.

SUMMARY OF THE INVENTION

It is therefore an object of the present invention to provide a connector having a structure which allows an easy check whether the connector is installed to a circuit board or not, and which enables to avoid a cumbersome work for installing the connector.

One aspect of the present invention provides a connector mountable on a circuit board and mateable with a mating connector along a mating direction. The connector comprises a contact, a housing, an enclosing portion and a coupling portion. The housing holds the contact. The enclosing portion encloses an outer circumference of the housing in a plane perpendicular to the mating direction. The coupling portion directly or indirectly couples the enclosing portion with the housing so as to allow the enclosing portion to move along the mating direction relative to the housing.

An appreciation of the objectives of the present invention and a more complete understanding of its structure may be had by studying the following description of the preferred embodiment and by referring to the accompanying drawings.

Figure 1:
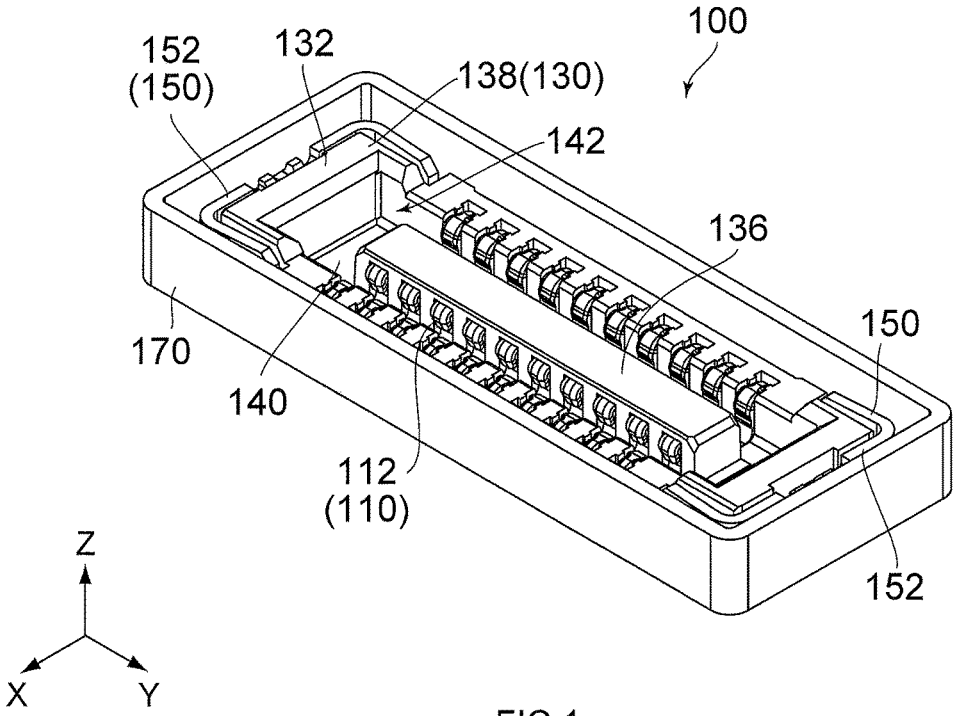
FIG. 1 is a top, perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 10:
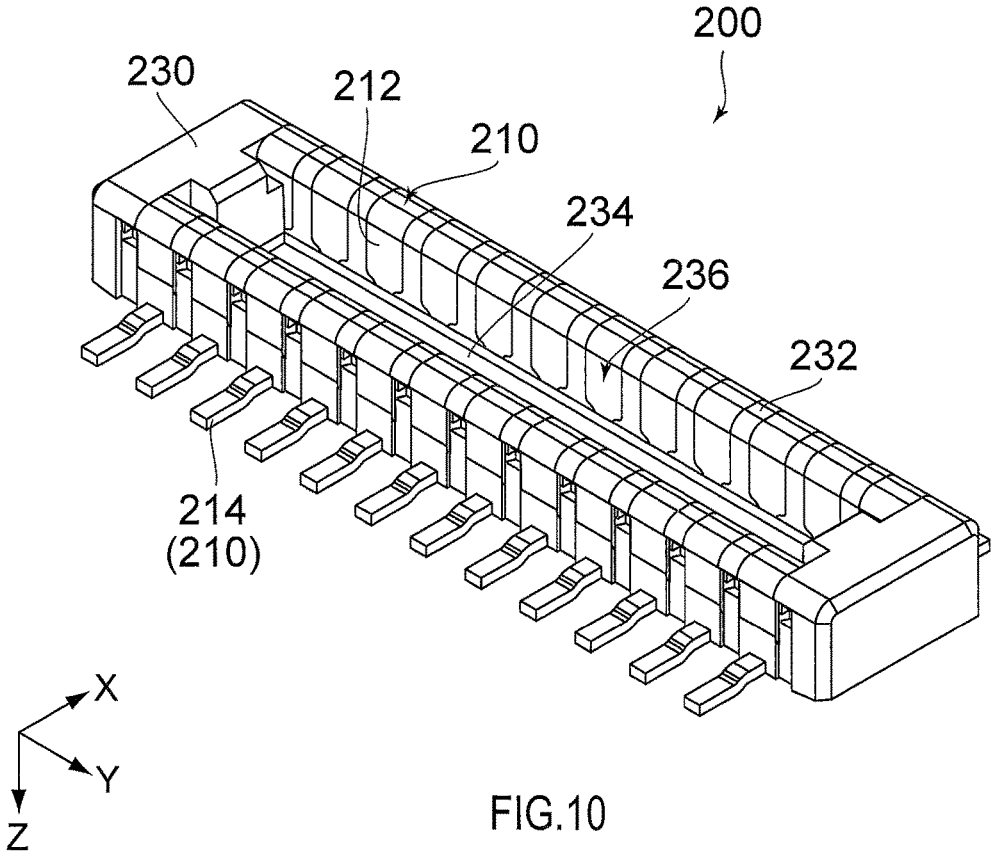
FIG. 10 is a perspective view showing a mating connector mateable with the connector of FIG. 1.
Figure 11:
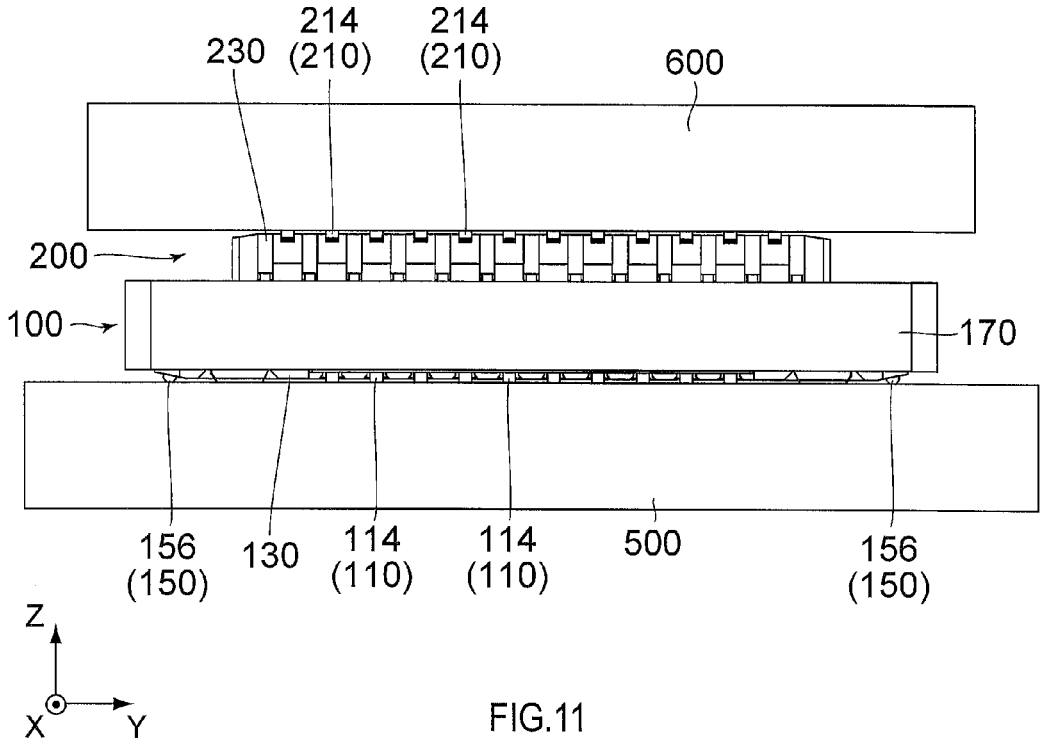
FIG. 11 is a side view showing the connector of FIG. 1 and the mating connector of FIG. 10, wherein the connector and the mating connector are in a premated state where the connector and the mating connector are not mated with each other.

Referring to FIGS. 1, 10 and 11, a connector 100 according to a first embodiment of the present invention is a receptacle while a mating connector 200 is a plug. The connector 100 is mateable with the mating connector 200 along a mating direction (Z-direction). As shown in FIGS. 11 to 14, the connector 100 is used in a state where the connector 100 is mounted on a circuit board 500 while the mating connector 200 is used in a state where the mating connector 200 is mounted on a mating circuit board 600.

As shown in FIG. 10, the mating connector 200 comprises a plurality of contacts 210 each made of a conductive material and a housing 230 made of an insulating material. Each of the contacts 210 has a contact portion 212 and an SMT portion 214. The contact portions 212 are electrically connected with the connector 100 under a mated state where the connector 100 mounted on the circuit board 500 and the mating connector 200 mounted on the mating circuit board 600 are mated with each other. The SMT portions 214 are configured to be connected and fixed to the mating circuit board 600. The housing 230 has an outer wall 232 and a bottom portion 234. The outer wall 232 has a rectangular frame-like shape. The housing 230 is formed with an accommodation portion 236 enclosed by the outer wall 232 and the bottom portion 234. The contacts 210 are embedded in the housing 230 via an insert-molding so as to be held by the housing 230. In detail, the contact portions 212 are exposed in the accommodation portion 236 while the SMT portions 214 extend outward in the X-direction from the housing 230.

As shown in FIGS. 1 to 4, the connector 100 comprises a plurality of contacts 110 each made of a conductive material, a housing 130 made of an insulating material, two reinforcement members 150 each made of a metal, two coupling portions 160 each made of an elastic member which is stretchable and compressible, and a single enclosing portion 170 made of an elastic member. The housing 130 holds the contacts 110. The reinforcement members 150 are held by the housing 130 and reinforce the housing 130. According to the present embodiment, the coupling portion 160 and the enclosing portion 170 are formed from the same material as each other.

Figure 9:
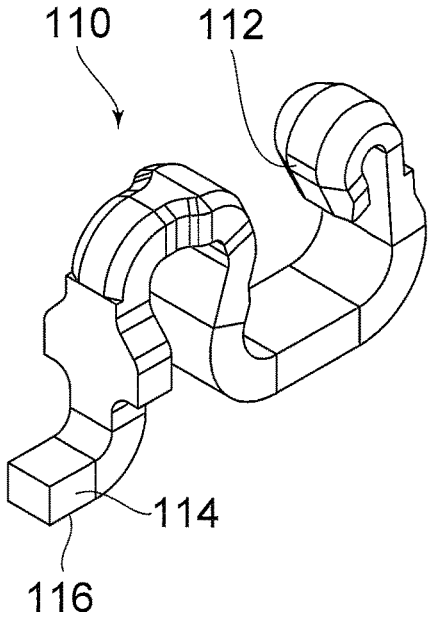
FIG. 9 is a perspective view showing a contact of the connector of FIG. 1.

As shown in FIG. 9, each of the contacts 110 has a contact portion 112 and an SMT portion 114. The contact portions 112 are connected to the contact portions 212 of the contacts 210 of the mating connector 200, respectively, under the mated state of the connector 100 with the mating connector 200. Each of the SMT portions 114 has a lower surface 116 configured to be connected to and fixed on the circuit board 500. In detail, when the connector 100 is mounted on the circuit board 500, the lower surfaces 116 of the SMT portions 114 are connected to the conductive patterns (not shown) formed on the circuit board 500, for example, by soldering so that the connector 100 is fixed to the circuit board 500.

Figure 2:
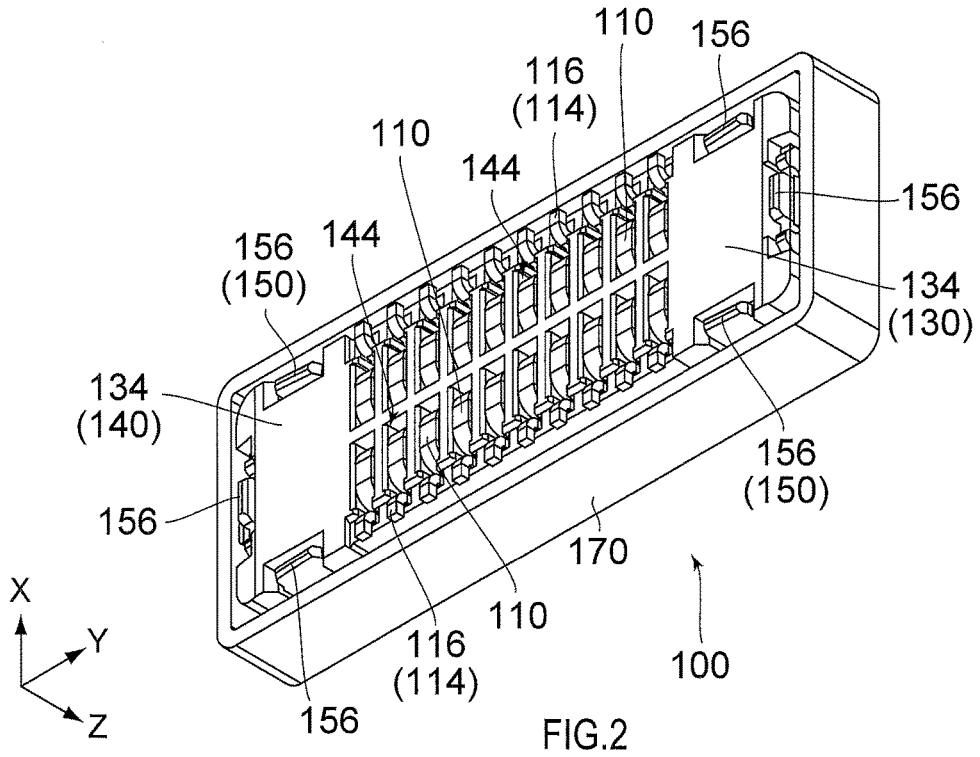
FIG. 2 is a bottom, perspective view showing the connector of FIG. 1.
Figure 3:
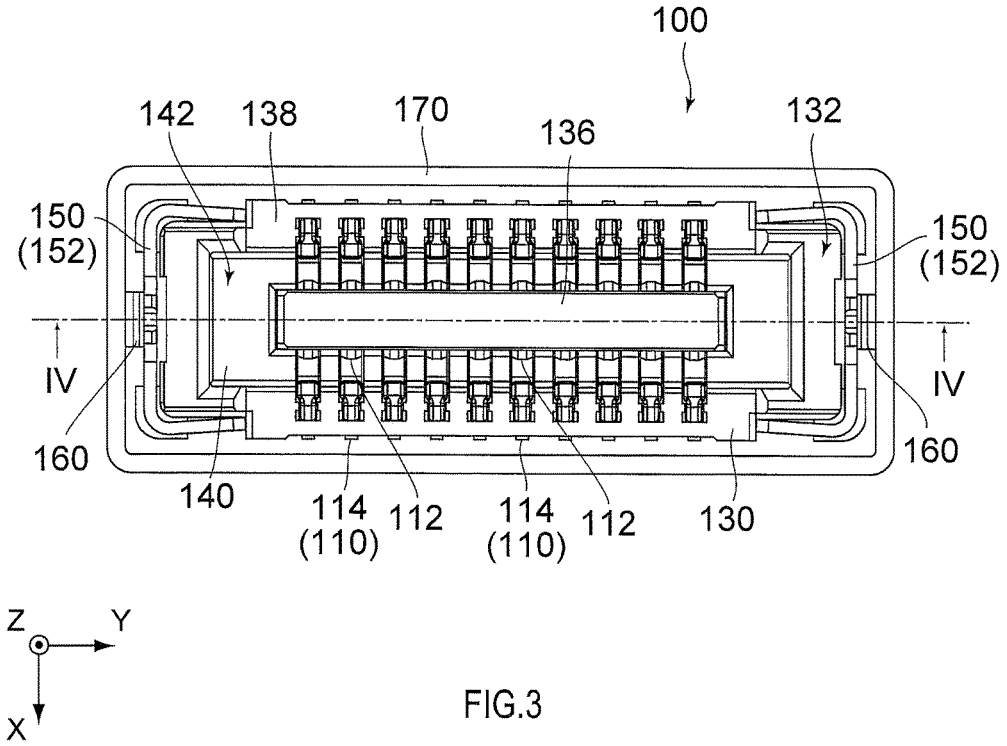
FIG. 3 is a top view showing the connector of FIG. 1.
Figure 4:
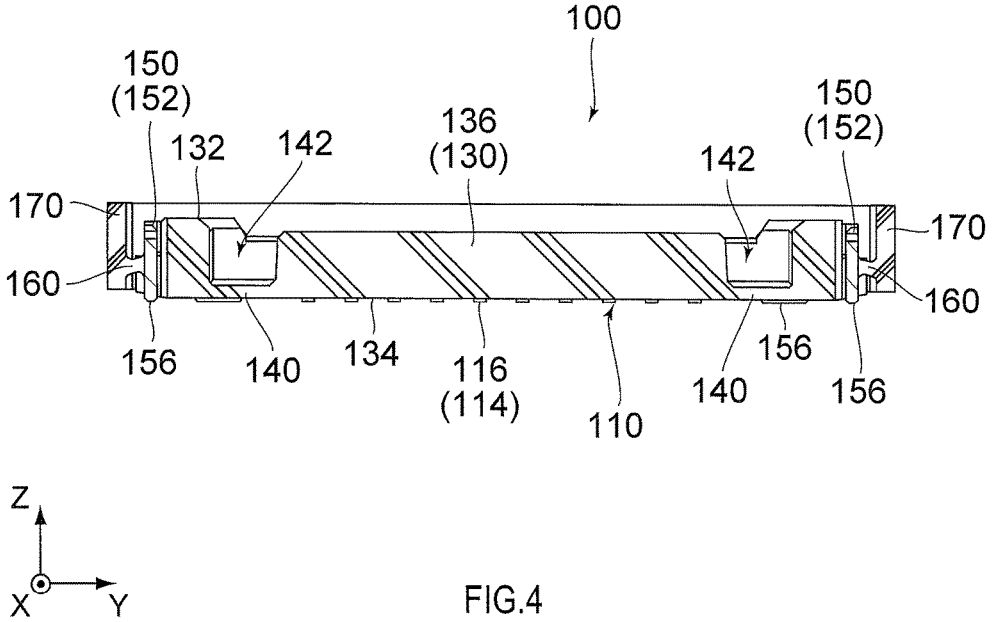
FIG. 4 is a cross-sectional view showing the connector of FIG. 3, taken along line IV-IV.
Figure 8:
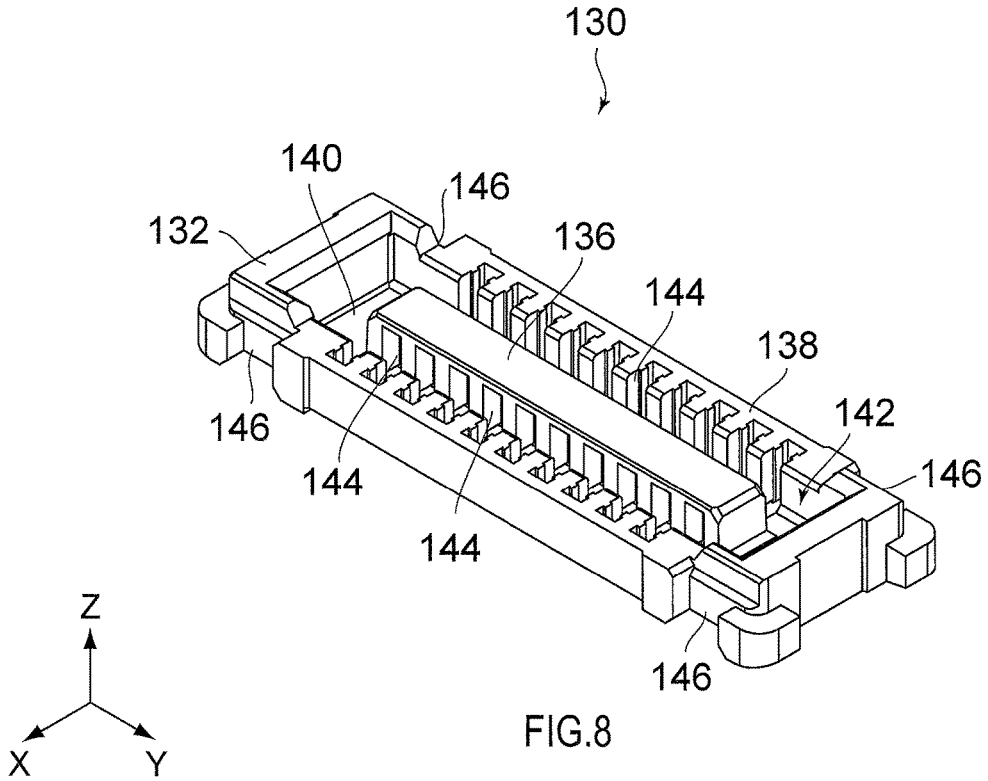
FIG. 8 is a perspective view showing a housing of the connector of FIG. 1.

As shown in FIG. 8, the housing 130 has a protruding portion 136, an outer wall 138 and a bottom portion 140. The protruding portion 136 protrudes in the Z-direction while extending in the Y-direction (lengthwise direction). The outer wall 138 is arranged so as to be apart from the protruding portion 136 while enclosing the protruding portion 136 in the XY-plane perpendicular to the Z-direction. The bottom portion 140 couples the negative Z-side of the outer wall 138 and the negative Z-side of the protruding portion 136 with each other. The protruding portion 136 is accommodated in the accommodation portion 236 provided in the housing 230 of the mating connector 200 under the mated state of the connector 100 with the mating connector 200. The housing 130 is provided with a receive portion 142. The receive portion 142 is formed between the protruding portion 136 and the outer wall 138. The receive portion 142 receives the outer wall 232 of the housing 230 of the mating connector 200 under the mated state. The housing 130 is formed with a plurality of contact-accommodation portions 144. Each of the contact-accommodation portions 144 pierces the bottom portion 140 in the Z-direction while extending in the X-direction to both the inside of the protruding portion 136 and the inside of the outer wall 138. As shown in FIG. 2, the contacts 110 are press-fit through a lower surface 134 of the housing 130 in the contact-accommodation portions 144, respectively. As shown in FIGS. 1 and 3, the contact portions 112 of the contacts 110, which are press-fit, are exposed in the receive portion 142. As shown in FIGS. 2 to 4, the SMT portions 114 of the contacts 110, which are press-fit, extend toward the outside of the housing 130 in the X-direction. Each of the SMT portions 114 protrudes at least in part from an outer circumference of the housing 130 in the XY-plane. As shown in FIG. 8, the housing 130 has four holding portions 146 which are formed at four positions thereof, respectively. The holding portions 146 are portions for holding the reinforcement members 150.

Figure 5:
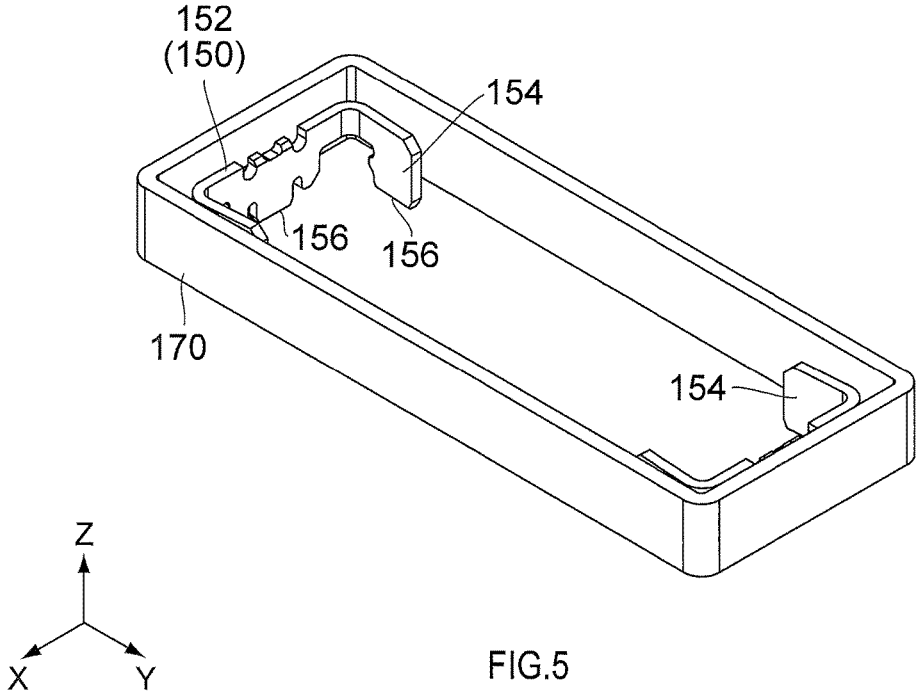
FIG. 5 is a perspective view showing a structure of the connector of FIG. 1, wherein the structure has a reinforcement member, a coupling portion and an enclosing portion.
Figure 6:
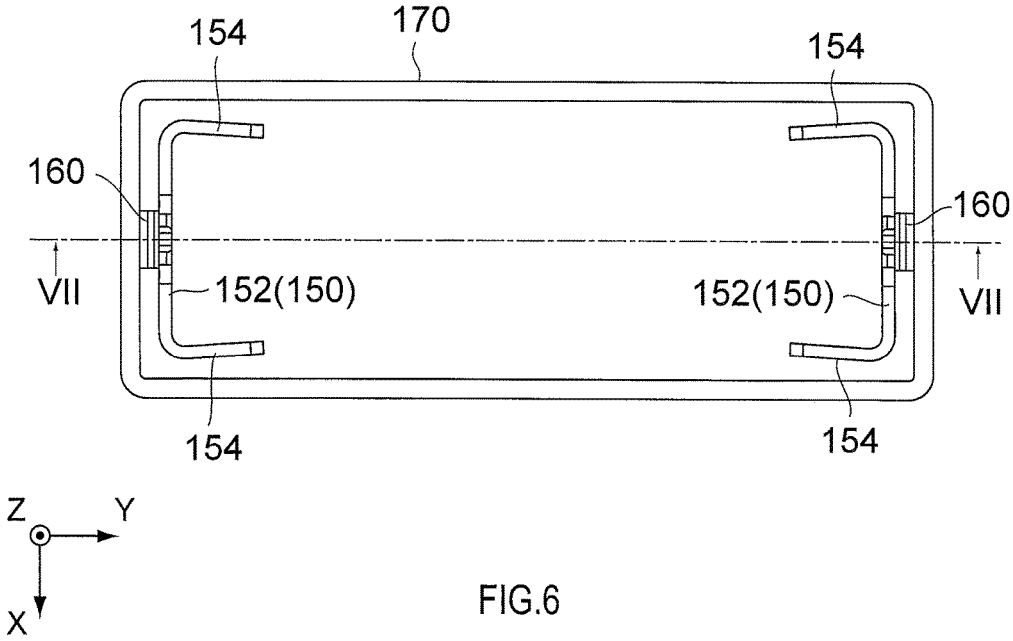
FIG. 6 is a top view showing the structure of FIG. 5.
Figure 7:
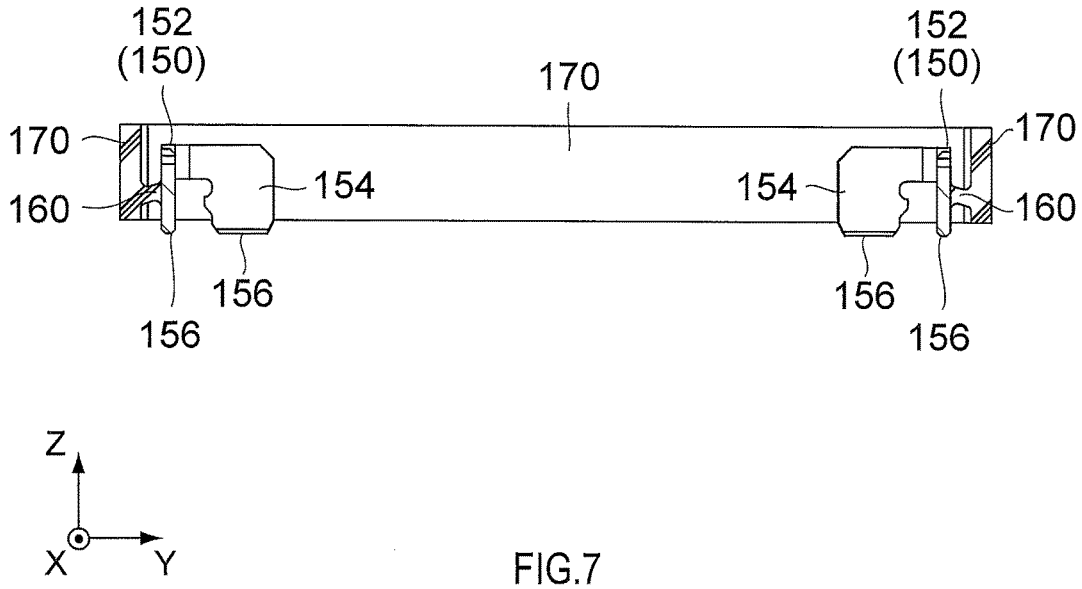
FIG. 7 is a cross-sectional view showing the structure of FIG. 6, taken along line VII-VII.

As shown in FIGS. 5 to 7, each of the coupling portions 160 directly couples the corresponding one of the two reinforcement members 150 with the enclosing portion 170. Accordingly, the coupling portions 160 indirectly couple the enclosing portion 170 with the housing 130. According to the present embodiment, the reinforcement members 150 are insert-molded to be connected to the coupling portions 160, respectively, when the enclosing portion 170 and the coupling portions 160 are molded. As best shown in FIGS. 6 and 7, the coupling portion 160 is located inside of the enclosing portion 170 in the Y-direction (Y-direction) while connecting the enclosing portion 170 and the reinforcement member 150 to each other.

Figure 12:
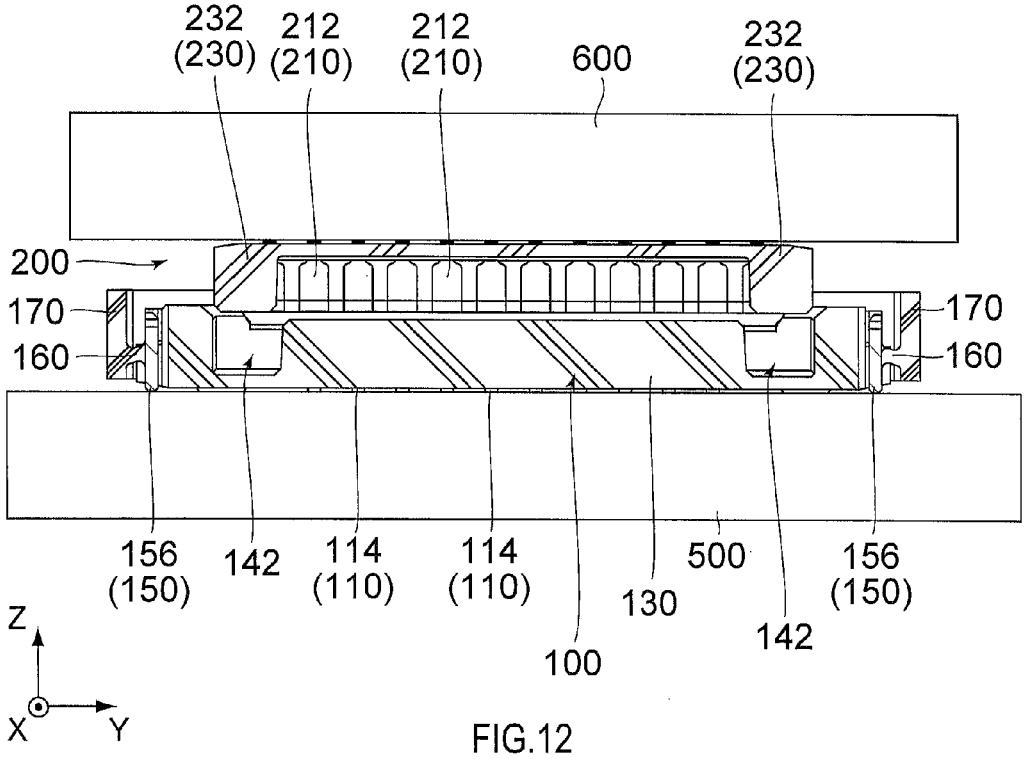
FIG. 12 is a cross-sectional view showing the connector and the mating connector of FIG. 11.

Each of the reinforcement members 150 has a body portion 152, two held portions 154, and three abutment portions 156. The body portion 152 extends along the X-direction. The held portions 154 are formed at opposite ends of the body portion 152 in the X-direction, respectively. One of the abutment portions 156 is formed at a lower part of the body portion 152 while the other two of the abutment portions 156 are formed at lower parts of the held portions 154, respectively. The two held portions 154 of each of the reinforcement members 150 are press-fit in two of the holding portions 146 of the housing 130, respectively, so that the reinforcement members 150 are held by the housing 130. As shown in FIGS. 11 and 12, when the connector 100 is mounted on and fixed to the circuit board 500, the abutment portions 156 are brought into abutment with the circuit board 500 and connected to the patterns (not shown) formed on the circuit board 500, for example, by soldering.

The enclosing portion 170 has a rectangular frame-like or rectangular ring-like shape. As shown in FIGS. 1 to 4, the reinforcement members 150 are attached to the housing 130 so that the enclosing portion 170 encloses the outer circumference of the housing 130 in the XY-plane.

Each of the coupling portions 160 is made of the stretchable and compressible elastic member so that the enclosing portion 170 is allowed to move along the Z-direction relative to the housing 130. For example, when a force along the negative Z-direction is applied to the enclosing portion 170, the coupling portions 160 are stretched so that the enclosing portion 170 is moved in the negative Z-direction from an initial position. In other words, according to the present embodiment, a predetermined method which enables the relative movement of the enclosing portion 170 is the stretchable and compressible elastic member. This predetermined method may be, for example, a mechanical structure, provided that the enclosing portion 170 is movable relative to the housing 130 along the Z-direction. However, if the predetermined method is realized by the mechanical structure or the like, a size of the connector 100 might become large. Accordingly, the coupling portion 160 is preferred to be formed from an elastic member. Moreover, the enclosing portion 170 is preferred to return to the initial position under a state where the force, which is applied to relatively move the enclosing portion 170, is released. Accordingly, the coupling portion 160 is further preferred to be formed from the stretchable and compressible elastic member which has a restoring force.

As shown in FIG. 3, the enclosing portion 170 has a shape which allows the SMT portions 114 to be visible when the upper surface 132 of the housing 130 is seen along the Z-direction. In other words, when the upper surface 132 of the housing 130 is seen along the Z-direction, the SMT portions 114, which protrude to the outside of the housing 130, are visible. Accordingly, when the connector 100 is mounted on and fixed to the circuit board 500, it is possible to check from the above (i.e. from the positive Z-side of the connector 100) whether each of the SMT portions 114 is connected to the circuit board 500 or not (i.e. a connection state between the SMT portions 114 and the circuit board 500).

As shown in FIG. 4, the enclosing portion 170 protrudes upward beyond the upper surface 132 of the housing 130. The enclosing portion 170 is supported by the coupling portions 160 so as to be apart from the circuit board 500 under an initial state where the connector 100 is mounted on the circuit board 500 but has not been mated with the mating connector 200 even once. Accordingly, the connection state between the SMT portions 114 and the circuit board 500 is also checkable from a lateral side of the connector 100 (i.e. along the X-direction).

Figure 13:
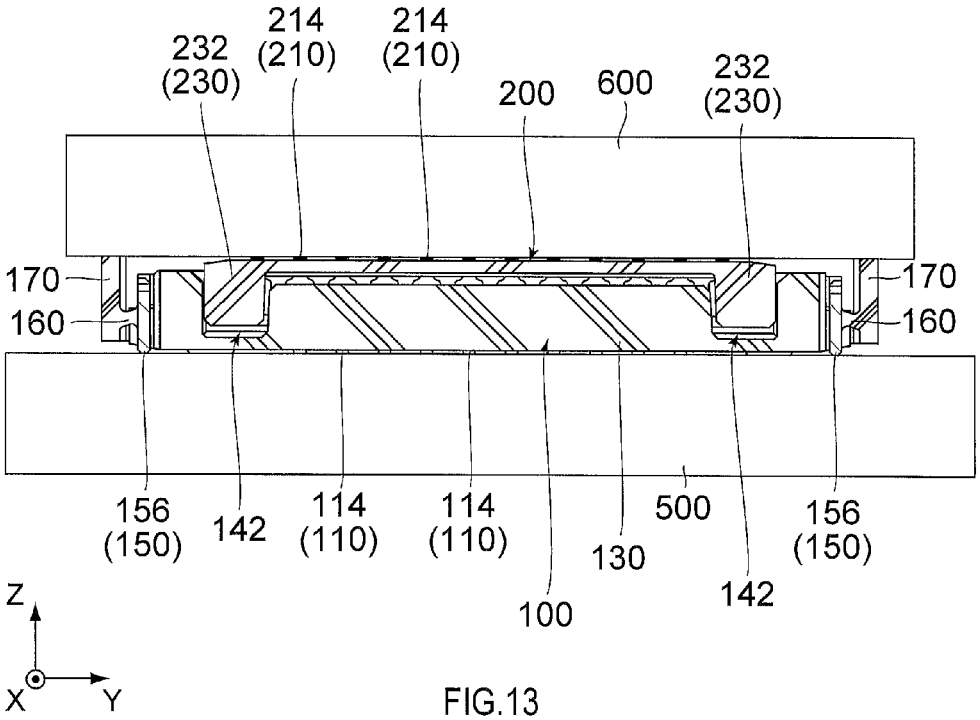
FIG. 13 is a cross-sectional view showing the connector and the mating connector in an incompletely mated state, which is subsequent to the premated state of FIG. 12, in a mating process.
Figure 14:
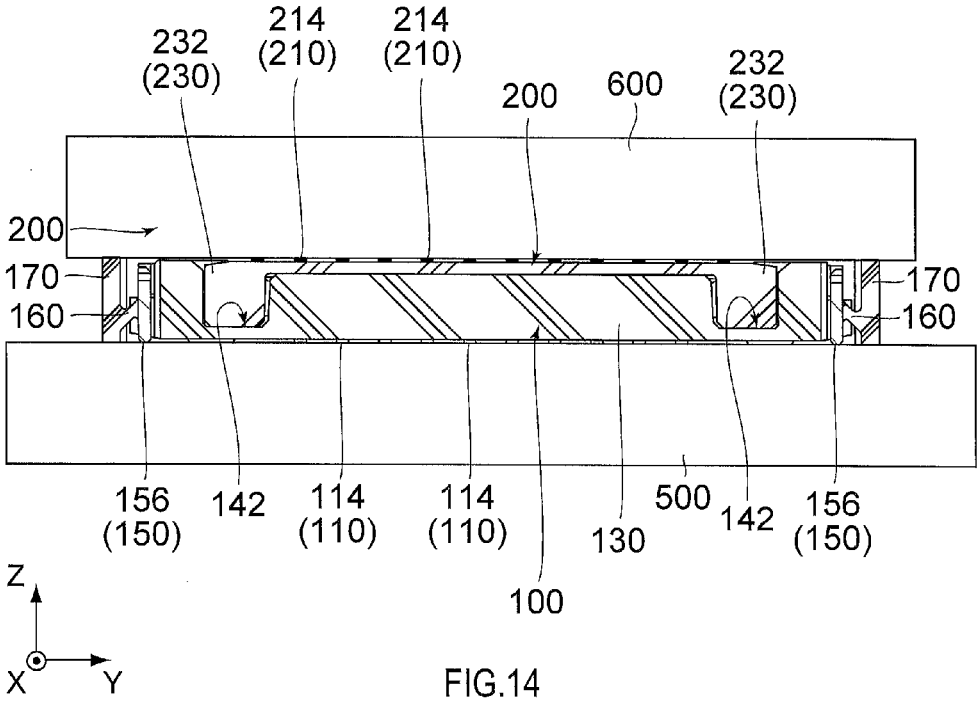
FIG. 14 is a cross-sectional view showing the connector and the mating connector in a mated state, which is subsequent to the incompletely mated state of FIG. 13, in the mating process.
Figure 15:
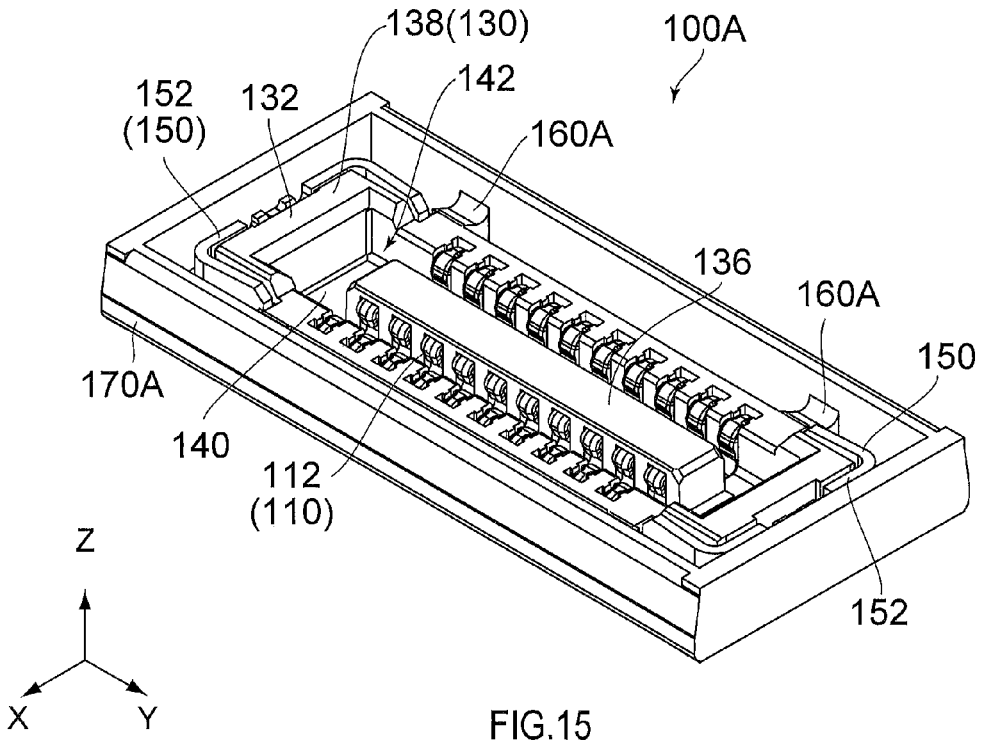
FIG. 15 is a top, perspective view showing a connector according to a second embodiment of the present invention.
Figure 16:
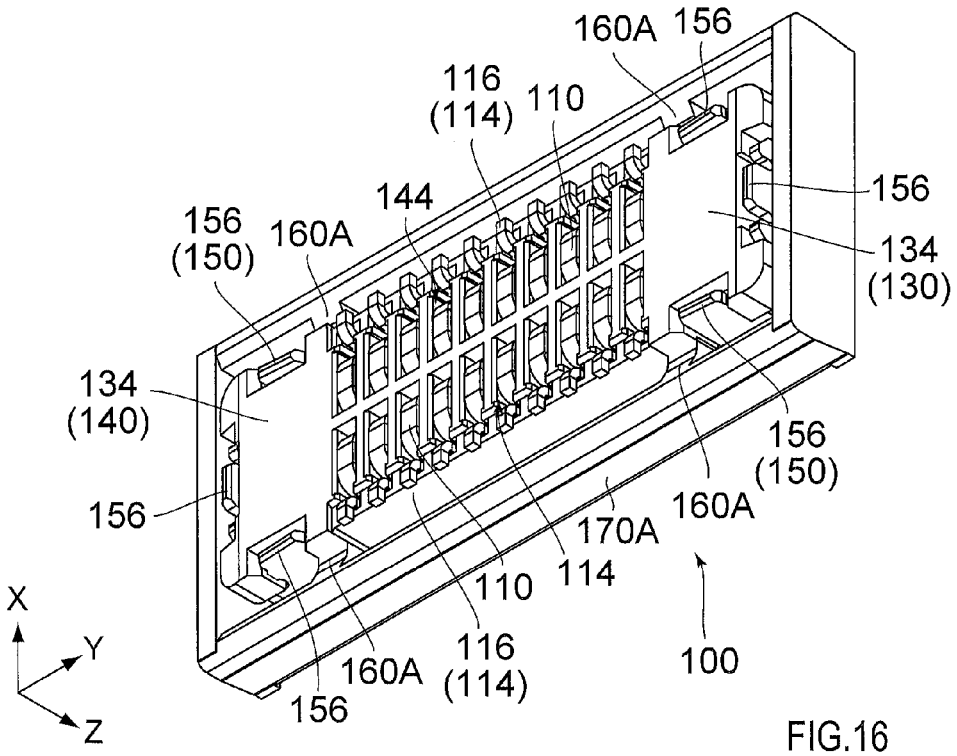
FIG. 16 is a bottom, perspective view showing the connector of FIG. 15.

As shown in FIG. 4, the enclosing portion 170 in the Z-direction is equal to or more than a distance between the lower surface 116 of the SMT portion 114 and the upper surface 132 of the housing 130. (i.e. a height of the housing 130). Moreover, as shown in FIGS. 11 to 14, the size of the enclosing portion 170 according to the present embodiment in the Z-direction is equal to or more than a distance between the circuit board 500 and the mating circuit board 600 under the mated state of the connector 100 with the mating connector 200. Accordingly, as shown in FIG. 14, the enclosing portion 170 is brought into abutment and contact with both the circuit board 500 and the mating circuit board 600 under the mated state to form an enclosed space which is completely enclosed (i.e. sealed up in a dust proof manner) by the enclosing portion 170, the circuit board 500 and the mating circuit board 600. As shown in FIG. 14, the contacts 110 and the housing 130 of the connector 100 together with the contacts 210 and the housing 230 of the mating connector 200 are located within the enclosed space formed by the enclosing portion 170 etc. under the mated state to be protected from a contamination or the like. Thus, a protection against dust is obtained.

As described above, according to the present embodiment, the enclosing portion 170 is provided so as to be movable relative to the housing 130 along the Z-direction. Accordingly, as shown in FIGS. 12 to 14, the enclosing portion 170 is movable in the Z-direction without any extra operation during a mating process where the connector 100 is mated with the mating connector 200. In detail, as shown in FIG. 12, the mating process of the connector 100 with the mating connector 200 proceeds from a premated state where the connector 100 and the mating connector 200 are not mated with each other. As shown in FIG. 13, as the mating process proceeds, an upper end (i.e. the positive-Z side end) of the enclosing portion 170 is brought into abutment with the mating circuit board 600. Afterward, as the mating process further proceeds, the enclosing portion 170 is pressed downward (i.e. in the negative Z-direction) by the mating circuit board 600 while the coupling portions 160 are stretched. Accordingly, the enclosing portion 170 moves toward the circuit board 500. As the mating process further proceeds, a lower end (i.e. the negative-Z side end) of the enclosing portion 170 is brought into abutment with the circuit board 500. As described above, the size of the enclosing portion 170 in the Z-direction is equal to or more than the height of the housing 130. Accordingly, the enclosing portion 170 receives a force from the mating circuit board 600 even after the lower end of the enclosing portion 170 is brought into abutment with the circuit board 500. As shown in FIG. 14, under the mated state where the connector 100 is finally mated with the mating connector 200, the enclosing portion 170 is brought into abutment with both the circuit board 500 and the mating circuit board 600 so that the aforementioned enclosed space is formed. Thus, the aforementioned protection against dust is obtained. Specifically, the enclosing portion 170 is brought into contact with both the circuit board 500 and the mating circuit board 600 with no gap under the mated state to form an enclosed space which is completely enclosed by the enclosing portion 170, the circuit board 500, and the mating circuit board 600 so that the enclosing portion 170, the circuit board 500, and the mating circuit board 600 form a dust-proof seal of the enclosing space that protects against all dust from entering the enclosing space.

Second Embodiment

Referring to FIGS. 15 to 19, a connector 100A according to a second embodiment of the present invention is a modification of the connector 100 according to the aforementioned first embodiment. The connector 100A has a structure same as the connector 100 except differences in configurations of coupling portions 160A and enclosing portion 170A and a difference in a relation of the housing 130 and the reinforcement members 150 with the coupling portions 160A and the enclosing portion 170A. Moreover, the mating connector 200 is same as that of the first embodiment (see FIGS. 10 and 23). Accordingly, in the following description, a component of the connector 100A, which has the same structure as the component of the connector 100 according to the first embodiment, is referred to by using the same sign and simply described. In the following description, differences in the connector 100A are described in detail.

As shown in FIGS. 15 to 18, the connector 100A comprises a plurality of the contacts 110 each made of the conductive material, the housing 130 made of the insulating material, the two reinforcement members 150 each made of the metal, four coupling portions 160A each made of an elastic member which is stretchable and compressible, and a single enclosing portion 170A made of an elastic member. The housing 130 holds the contacts 110. The reinforcement members 150 are held by the housing 130 and reinforce the housing 130. According to the present embodiment, the coupling portion 160A and the enclosing portion 170A are formed from the same material as each other.

Figure 19:
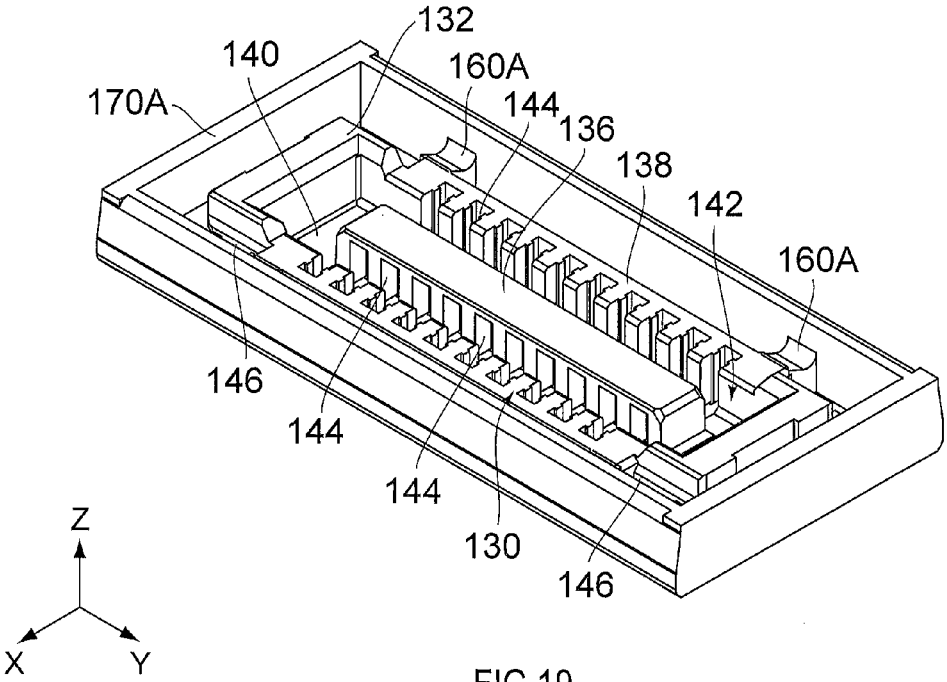
FIG. 19 is a perspective view showing a structure of the connector of FIG. 15, wherein the structure has a housing, a coupling portion and an enclosing portion.
Figure 20:
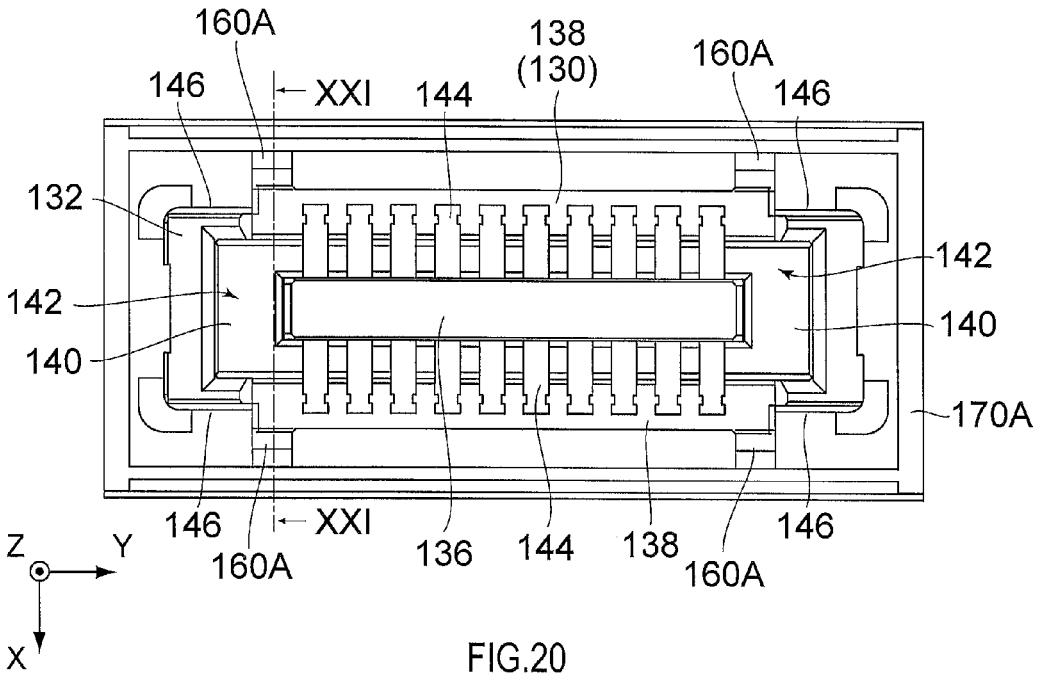
FIG. 20 is a top view showing the structure of FIG. 19.
Figure 21:
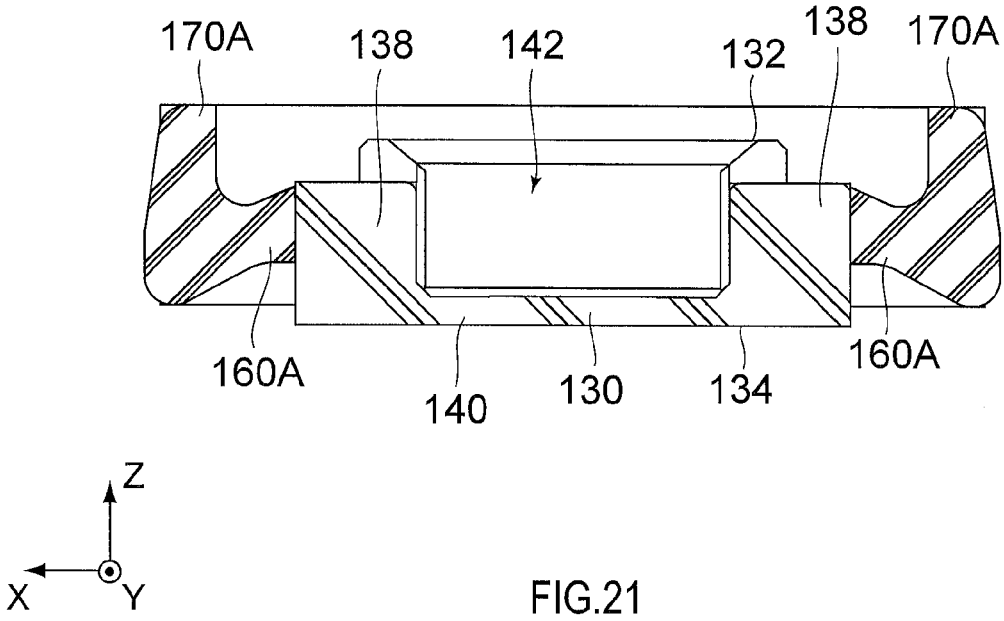
FIG. 21 is a cross-sectional view showing the structure of FIG. 20, taken along line XXI-XXI.
Figure 22:
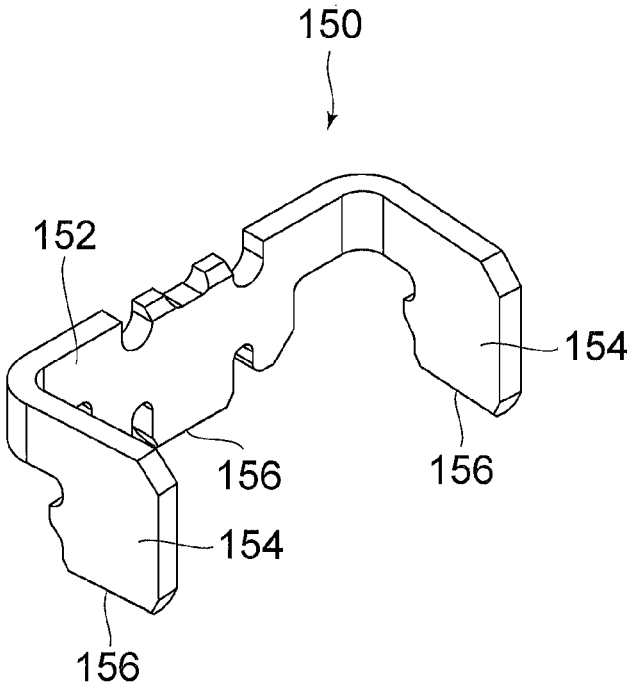
FIG. 22 is a perspective view showing a reinforcement member of the connector of FIG. 15.

As shown in FIGS. 5 to 7, according to the aforementioned first embodiment, the enclosing portion 170 is coupled with the reinforcement members 150 by the coupling portions 160. On the other hand, as shown in FIG. 22, according to the present embodiment, the reinforcement members 150 is not formed integrally with the enclosing portion 170A and the coupling portion 160A. As shown in FIGS. 19 to 21, according to the present embodiment, the enclosing portion 170A is directly coupled with the housing 130 by the four coupling portions 160A. In detail, the outer wall 138 of the housing 130 has two walls which extend in the Y-direction (lengthwise direction). Two of the coupling portions 160A are arranged on the outside of each of the aforementioned two walls. Each of the coupling portions 160A couples an inner circumference of the enclosing portion 170A with the outer circumference of the housing 130.

More specifically, the coupling portion 160A and the enclosing portion 170A are made of the same material as each other. However, each of the coupling portion 160A and the enclosing portion 170A is made of a different material from the housing 130. The coupling portions 160A and the enclosing portion 170A are integrally formed with the housing 130 via a two-shot molding. In other words, the coupling portions 160A are molded together with the housing 130 and the enclosing portion 170A so as to be connected to the housing 130 and the enclosing portion 170A.

The enclosing portion 170A according to the present embodiment has a little different shape from the enclosing portion 170 according to the aforementioned first embodiment. However, the enclosing portion 170A has a rectangular frame-like or rectangular ring-like shape similar to the enclosing portion 170. As shown in FIGS. 19 to 21, the enclosing portion 170A encloses the outer circumference of the housing 130 in the XY-plane.

The coupling portion 160A according to the present embodiment is made of an elastic member which is stretchable and compressible. Accordingly, the enclosing portion 170A is movable along the Z-direction relative to the housing 130. Moreover, the enclosing portion 170A is returnable to its initial position when a force, which is applied to the enclosing portion 170A to relatively move the enclosing portion 170A, is released.

Figure 17:
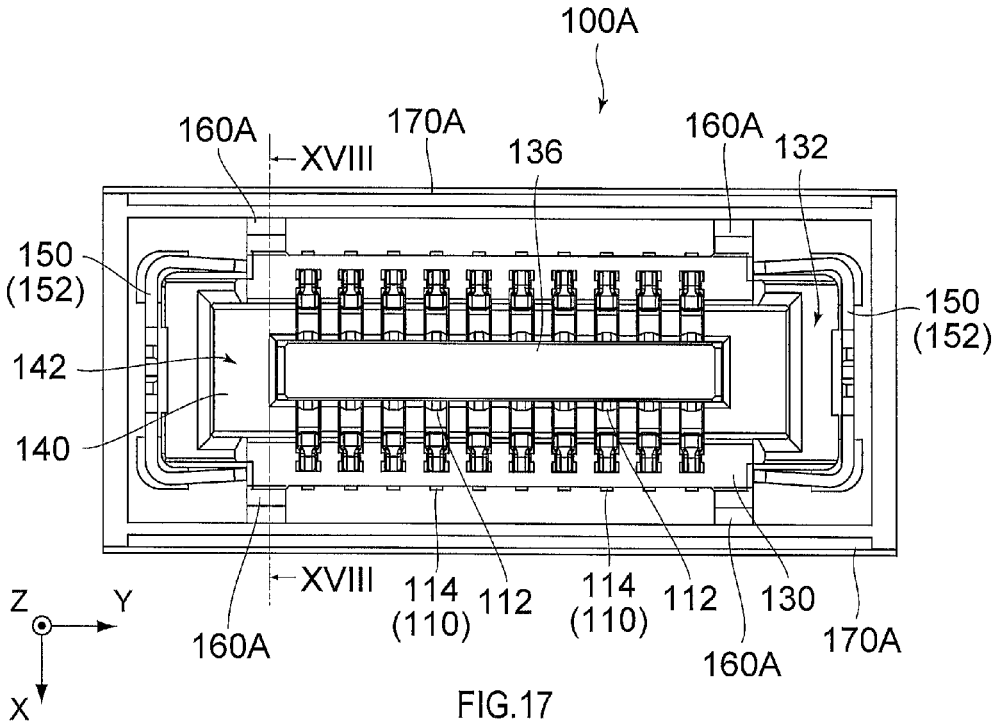
FIG. 17 is a top view showing the connector of FIG. 15.

As shown in FIG. 17, also according to the present embodiment, when the upper surface 132 of the housing 130 is seen along the Z-direction, the SMT portions 114, which protrude to the outside of the housing 130, are visible. Accordingly, when the connector 100A is mounted on and fixed to the circuit board 500, it is possible to check the connection state between the SMT portions 114 and the circuit board 500 from the above (i.e. from the positive Z-side of the connector 100A).

Figure 23:
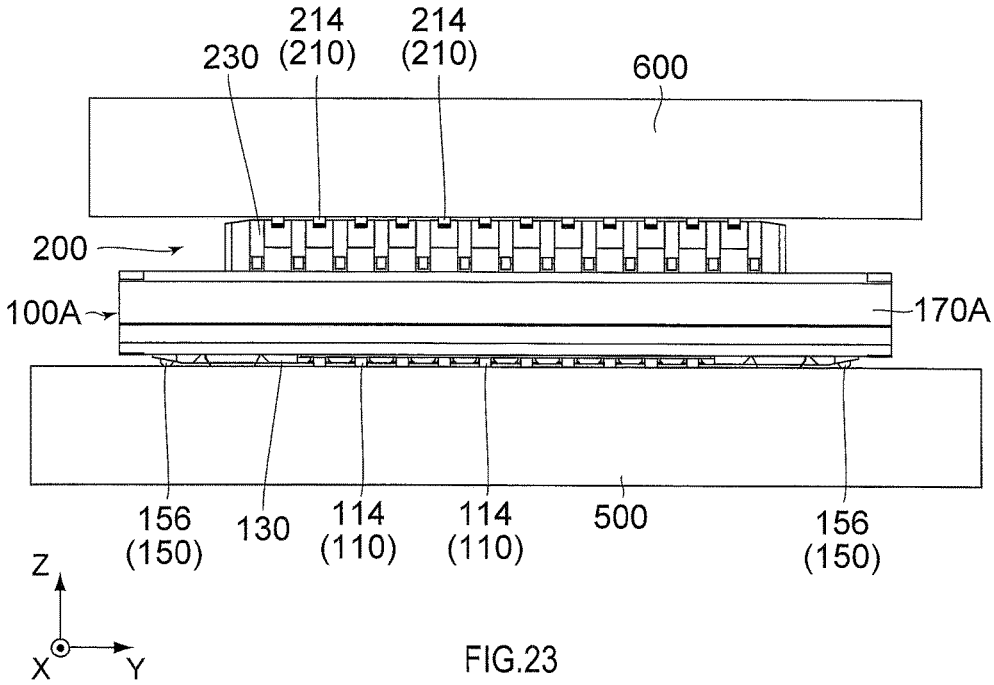
FIG. 23 is a side view showing the connector of FIG. 15 and the mating connector of FIG. 10, wherein the connector and the mating connector are in the premated state.
Figure 24:
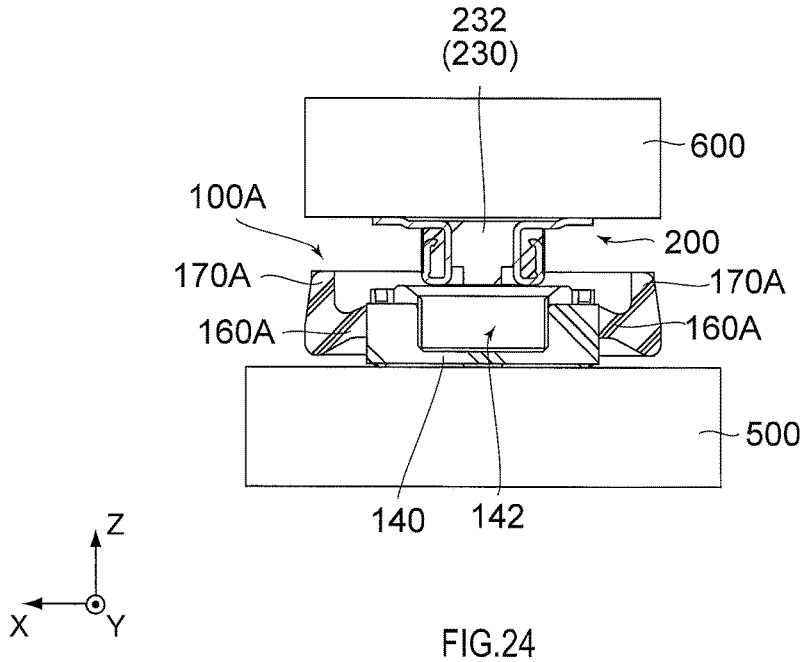
FIG. 24 is a cross-sectional view showing the connector and the mating connector of FIG. 23.

As shown in FIGS. 23 and 24, the enclosing portion 170A is supported by the coupling portions 160A so as to be apart from the circuit board 500 under an initial state. Accordingly, the connection state between the SMT portions 114 and the circuit board 500 is also checkable from a lateral side of the connector 100A (i.e. along the X-direction).

Figure 18:
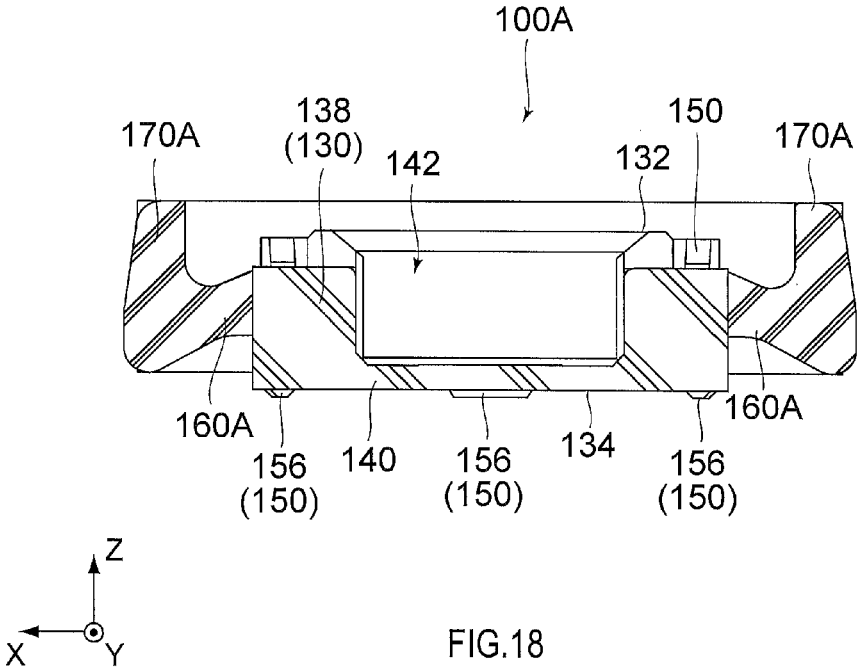
FIG. 18 is a cross-sectional view showing the connector of FIG. 17, taken along line XVIII-XVIII.
Figure 26:
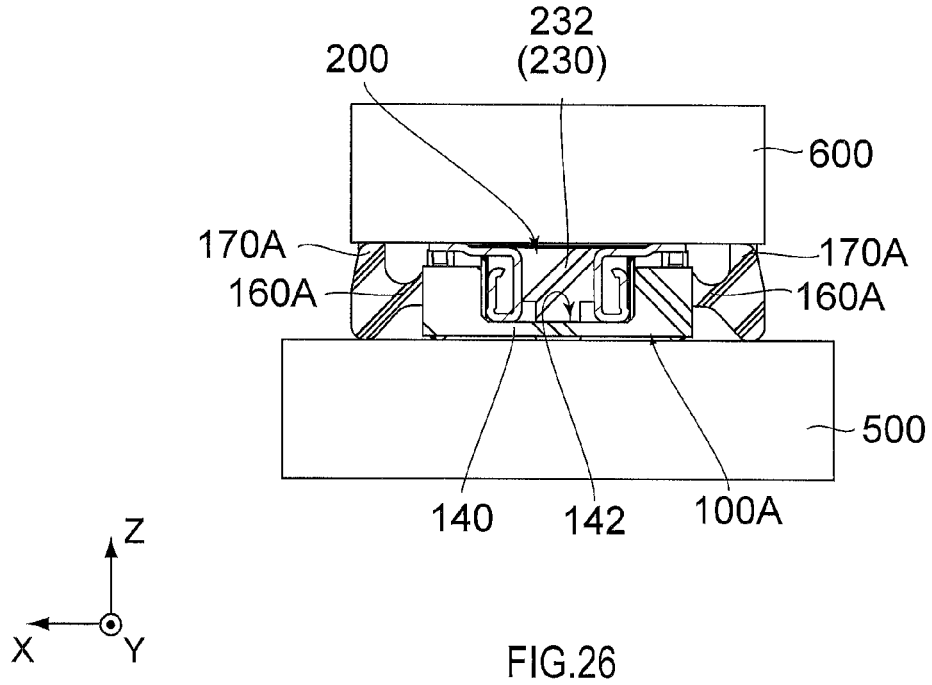
FIG. 26 is a cross-sectional view showing the connector and the mating connector in the mated state, which is subsequent to the incompletely mated state of FIG. 25, in the mating process.
Figure 27:
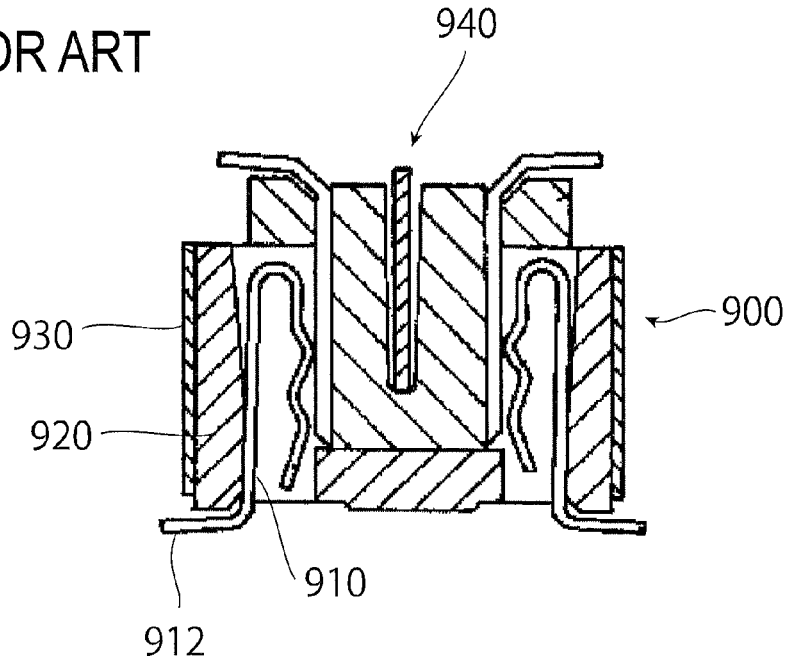
FIG. 27 is a cross-sectional view showing an existing connector and an existing mating connector.
Figure 28:
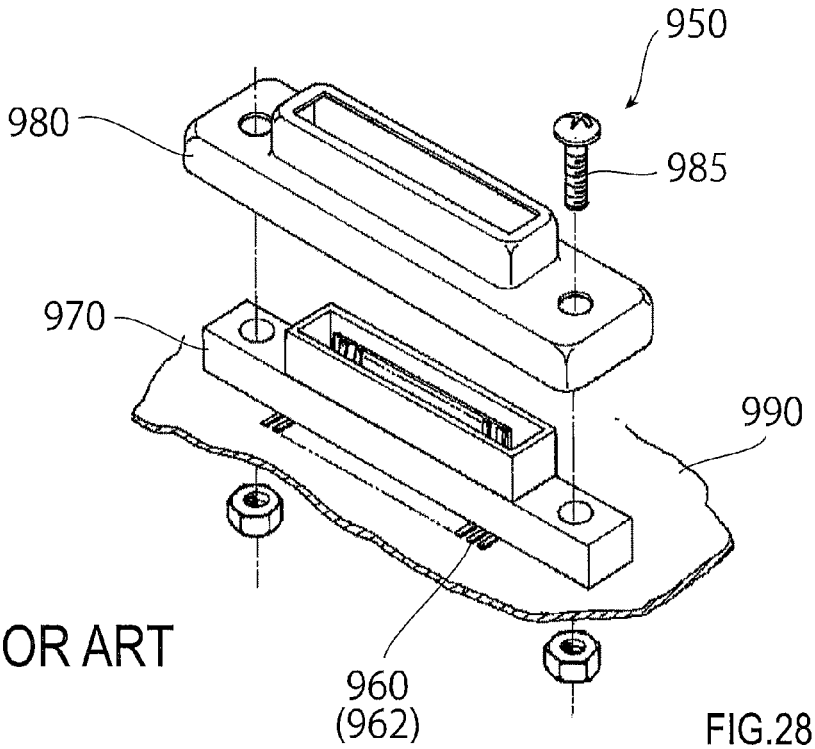
PRIOR ART FIG.28
FIG. 28 is an exploded, perspective view showing another existing connector.

As shown in FIG. 18, a size of the enclosing portion 170A in the Z-direction is equal to or more than the distance between the lower surface 116 of the SMT portion 114 and the upper surface 132 of the housing 130. Moreover, as shown in FIGS. 24 and 26, the size of the enclosing portion 170A according to the present embodiment in the Z-direction is equal to or more than the distance between the circuit board 500 and the mating circuit board 600 under the mated state of the connector 100A with the mating connector 200. Accordingly, as shown in FIG. 26, the enclosing portion 170A is brought into abutment and contact with both the circuit board 500 and the mating circuit board 600 under the mated state to form an enclosed space which is completely enclosed (i.e. sealed up to form a dust-proof seal) by the enclosing portion 170A, the circuit board 500 and the mating circuit board 600. As shown in FIG. 26, the contacts 110 and the housing 130 of the connector 100A together with the contacts 210 and the housing 230 of the mating connector 200 are located within the enclosed space formed by the enclosing portion 170 etc. under the mated state to be protected from a contamination or the like. Thus, a protection against dust is obtained.

Figure 25:
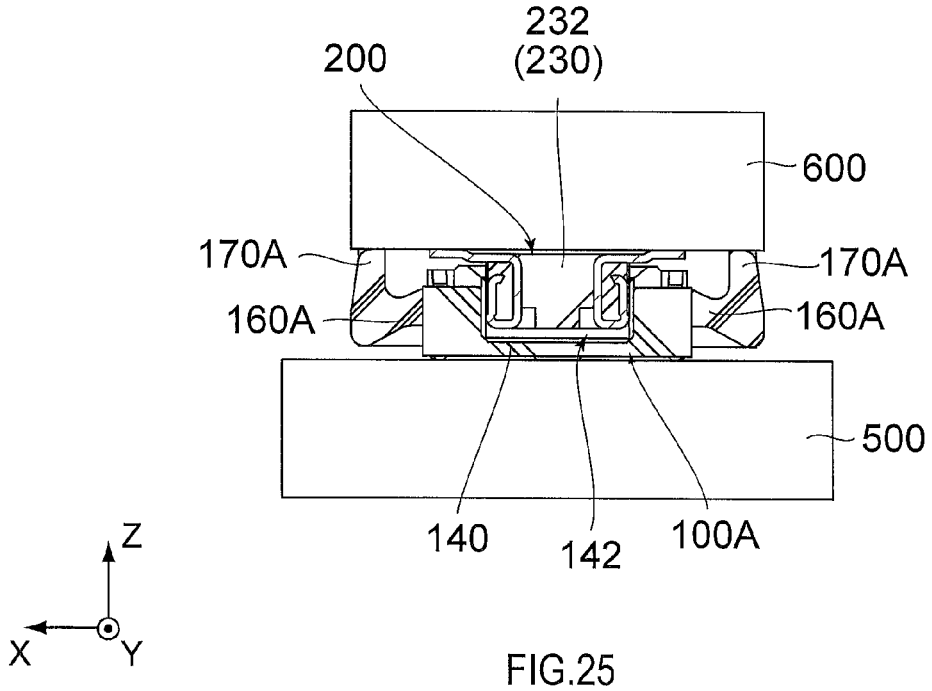
FIG. 25 is a cross-sectional view showing the connector and the mating connector in the incompletely mated state, which is subsequent to the premated state of FIG. 24, in the mating process.

As described above, according to the present embodiment, the enclosing portion 170A is provided so as to be movable relative to the housing 130 along the Z-direction. Accordingly, as shown in FIGS. 24 to 26, the enclosing portion 170A is movable in the Z-direction without any extra operation during a mating process where the connector 100A is mated with the mating connector 200. In detail, as the mating process of the connector 100A with the mating connector 200 proceeds from the premated state shown in FIG. 24, as shown in FIG. 25, an upper end (i.e. the positive-Z side end) of the enclosing portion 170A is brought into abutment with the mating circuit board 600. Afterward, as the mating process further proceeds, the enclosing portion 170A is pressed downward (i.e. in the negative Z-direction) by the mating circuit board 600 while the coupling portions 160A are stretched. Accordingly, the enclosing portion 170A moves toward the circuit board 500. As the mating process further proceeds, a lower end (i.e. the negative-Z side end) of the enclosing portion 170A is brought into abutment with the circuit board 500. As described above, the size of the enclosing portion 170A in the Z-direction is equal to or more than the height of the housing 130. Accordingly, the enclosing portion 170A receives a force from the mating circuit board 600 even after the lower end of the enclosing portion 170A is brought into abutment with the circuit board 500. As shown in FIG. 26, under the mated state where the connector 100A is finally mated with the mating connector 200, the enclosing portion 170A is brought into abutment with both the circuit board 500 and the mating circuit board 600 so that the aforementioned enclosed space is formed. Thus, the aforementioned protection against dust is obtained. Specifically, the enclosing portion 170A is brought into contact with both the circuit board 500 and the mating circuit board 600 with no gap under the mated state to form an enclosed space which is completely enclosed by the enclosing portion 170A, the circuit board 500, and the mating circuit board 600 so that the enclosing portion 170A, the circuit board 500, and the mating circuit board 600 for a dust-proof seal of the enclosing space that protects against all dust from entering the enclosing state.

As can be seen from the above description, according to each of the aforementioned embodiments, it is possible to move the enclosing portion after checking whether the connector is securely installed to a circuit board or not. Moreover, it is possible to avoid a cumbersome work for installing the connector.

The present invention is not limited to the aforementioned embodiments. For example, the aforementioned embodiments are able to be modified variously.

For example, according to the aforementioned embodiments, the coupling portion 160 and the enclosing portion 170 are formed from the same material as each other and integrally molded. Similarly, the coupling portion 160A and the enclosing portion 170A are formed from the same material as each other and integrally molded. However, the coupling portions 160 and 160A may be formed from materials different from the enclosing portions 170 and 170A, respectively. Moreover, the coupling portion 160 and the enclosing portion 170 may be connected or combined after each of the coupling portion 160 and the enclosing portion 170 is formed separately. Similarly, the coupling portion 160A and the enclosing portion 170A may be connected or combined after each of the coupling portion 160A and the enclosing portion 170A is formed separately. Moreover, each of the coupling portions 160 and 160A may not be formed from the stretchable and compressible elastic member. For example, each of the coupling portions 160 and 160A may be resiliently deformed by a bendable hinge. In addition, each of the enclosing portions 170 and 170A may have an electrical shielding capacity. In this case, each of the enclosing portions 170 and 170A may be formed from a metal. Otherwise, it is possible to form each of the enclosing portions 170 and 170A from an insulating material such as a resin. Thereafter, an outer circumference of each of the enclosing portions 170 and 170A, which are thus formed, may be covered with a foil or may be plated.

Moreover, the reinforcement members 150, the coupling portions 160 and the enclosing portion 170 may be formed from the same metal as each other. In this case, the coupling portion 160 may be resiliently deformed by a bendable hinge.

The present application is based on a Japanese patent application of JP2012-222703 filed before the Japan Patent Office on Oct. 5, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on a circuit board and mateable with a mating connector along a mating direction, the connector comprising:

a contact;

a housing holding the contact;

a single enclosing portion enclosing an outer circumference of the housing in a plane perpendicular to the mating direction; and a coupling portion projecting from the enclosing portion toward the housing and directly or indirectly coupling the enclosing portion with the housing so as to allow the enclosing portion to move along the mating direction relative to the housing, wherein:

the enclosing portion is made of an elastic member;

the coupling portion is made of an elastic member which is stretchable and compressible such that the elastic member can generate a restoring force;

the enclosing portion and the coupling portion are integrally formed so that the coupling portion is a part of the enclosing portion;

the enclosing portion has an upper surface extending around an entire periphery of the enclosing portion and a lower surface extending around the entire periphery of the enclosing portion;

each of the upper surface and the lower surface of the enclosing portion extends with no irregularity around the entire periphery of the enclosing portion in a flat plane perpendicular to the mating direction;

the enclosing portion is formed with no hole to have a protection function against dust;

when a force along the mating direction is applied to the enclosing portion, the coupling portion is stretched so that the enclosing portion is moved from an initial position along the mating direction; and when the force is released the restoring force of the elastic member of the coupling portion returns the enclosing portion to the initial position.

2. The connector as recited in claim 1, wherein:

the contact has an Surface Mount Technology (SMT) portion, the SMT portion has a lower surface configured to be fixed on the circuit board; and a size of the enclosing portion in the mating direction is equal to or more than a distance between the lower surface of the SMT portion and an upper surface of the housing.

3. An assembly comprising a connector mountable on a circuit board and a mating connector mateable with the connector along a mating direction, wherein:

the mating connector mountable on a mating circuit board;

the connector comprises a contact, a housing holding the contact, a single enclosing portion, and a coupling portion projecting from the enclosing portion toward the housing, the coupling portion directly or indirectly coupling the enclosing portion with the housing so as to allow the enclosing portion to move along the mating direction relative to the housing, the enclosing portion is made of an elastic member;

the coupling portion is made of an elastic member which is stretchable and compressible such that the elastic member can generate a restoring force;

the enclosing portion and the coupling portion are integrally formed so that the coupling portion is a part of the enclosing portion;

when a force along the mating direction is applied to the enclosing portion, the coupling portion is stretched so that the enclosing portion is moved from an initial position along the mating direction;

when the force is released the restoring force of the elastic member of the coupling portion returns the enclosing portion to the initial position;

the enclosing portion has a size, in an unmated state, equal to or more than a distance between the circuit board and the mating circuit board under a mated state where the connector mounted on the circuit board and the mating connector mounted on the mating circuit board are mated with each other;

the enclosing portion is brought into contact with both the circuit board and the mating circuit board with no gap under the mated state to form an enclosed space which is completely enclosed by the enclosing portion, the circuit board and the mating circuit board so that the enclosing portion, the circuit board and the mating circuit board form a dust proof seal of the enclosing space that protects against all dust from entering the enclosing space; and the contact and the housing are located within the enclosed space under the mated state.

4. The connector as recited in claim 2, wherein:

the SMT portion protrudes at least in part from an outer circumference of the housing in a plane perpendicular to the mating direction; and the enclosing portion has a shape which allows the SMT portion to be visible when the upper surface of the housing is seen along the mating direction.

5. The connector as recited in claim 1, wherein the enclosing portion is supported by the coupling portion so as to be apart from the circuit board under an initial state where the connector is mounted on the circuit board while not mated with the mating connector even once.

6. The connector as recited in claim 1, the connector further comprising a reinforcement member which is held by the housing and reinforces the housing, wherein the coupling portion directly couples the reinforcement member with the portion.

7. The connector as recited in claim 6, wherein the reinforcement member is connected to the coupling portion when the coupling portion is molded.

8. The connector as recited in claim 1, wherein the coupling portion directly couples the housing with the enclosing portion.

9. The connector as recited in claim 8, wherein the coupling portion is molded together with the housing so as to be connected to the housing.

10. The connector as recited in claim 6, wherein the reinforcement member is formed separately from the housing.

11. The connector as recited in claim 6, wherein the reinforcement member is formed from a first type of material, wherein the housing is formed from a second type of material, and wherein the first type of material is different from the second type of material.

* * * * *